US007465174B1

(12) United States Patent
Haggis et al.

(10) Patent No.: US 7,465,174 B1
(45) Date of Patent: Dec. 16, 2008

(54) COUPLING FOR CONNECTING AND DISCONNECTING A PLUG AND A SOCKET

(75) Inventors: Theodore Paul Haggis, Raleigh, NC (US); Zachary Robert Purser, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/873,275

(22) Filed: Oct. 16, 2007

(51) Int. Cl.
*H01R 13/62* (2006.01)

(52) U.S. Cl. ..... 439/153

(58) Field of Classification Search ..... 439/8, 439/160, 152, 159, 476.1, 682
See application file for complete search history.

(56) References Cited

U.S. PATENT DOCUMENTS

| | | | | |
|---|---|---|---|---|
| 565,541 | A | 8/1896 | Hubbell | |
| 774,250 | A | 11/1904 | Hubbell | |
| 4,326,763 | A | 4/1982 | Ristovski | |
| 5,083,042 | A | 1/1992 | Merchant | |
| 5,480,314 | A | 1/1996 | Campbell | |
| 6,419,504 | B1 * | 7/2002 | Nelson | 439/103 |
| 6,776,648 | B1 | 8/2004 | Hernando | |
| 7,193,873 | B2 * | 3/2007 | Lanni | 363/146 |
| 2002/0064983 | A1 * | 5/2002 | Patey | 439/152 |
| 2003/0228792 | A1 * | 12/2003 | Lanni | 439/528 |
| 2006/0030188 | A1 | 2/2006 | Pan et al. | |
| 2007/0155191 | A1 | 7/2007 | Buller et al. | |

OTHER PUBLICATIONS

Cord Connect A Watertight Card Lock! Cord Connect Power Lock Plug Connector from Angel-Guard Products, 2 pages, www.angelguardproducts.com , printed on Aug. 7, 2007.

* cited by examiner

*Primary Examiner*—Chandrika Prasad
(74) *Attorney, Agent, or Firm*—Cynthia S. Byrd; Jeffrey L. Streets

(57) ABSTRACT

One embodiment provides a coupling for connecting an electronic device to an electrical socket. A sleeve is slidably disposed on a coupling body. A plurality of male terminals at a distal end of the coupling body nearest to the electrical socket is configured for insertion into the electrical socket. The male terminals are in electronic communication with female terminals near a protective plug cavity at the proximate end of the coupling body. A plug of the electronic device is inserted into the plug cavity, whereupon prongs on the plug contact the female terminals. The sleeve and coupling body are movable axially with respect to each other from a prong-extended position, wherein the male terminals on the coupling body extend out of the sleeve, to a prong-retracted position, wherein the male terminals are substantially fully received within the sleeve, for disconnecting the coupling from the electrical socket. At least one release member is movable to cause the sleeve and the coupling body to move with respect to each other from the prong-extended position to the prong-retracted position.

20 Claims, 6 Drawing Sheets

COUPLING FOR CONNECTING AND DISCONNECTING A PLUG AND A SOCKET

BACKGROUND OF THE INVENTION

1. Field of the Invention

The present invention relates to electrical plugs and sockets for connecting and disconnecting electronic devices.

2. Description of the Related Art

A plug and socket are mating electrical connectors used to supply electrical power to an electronic device, such as a computer or home appliance. An electrical plug is typically a male electrical connector included with the electronic device that removably "plugs into" a female socket to receive electrical power from the socket, such as in the form of alternating current (AC) or, less commonly, direct current (DC). Terminals on the plug (i.e. "plug terminals") mate with terminals on the socket (i.e. "socket terminals") when plugged in. Plug terminals are usually male, and male plug terminals may be pins, prongs, blades, or combinations thereof. A plug with male terminals mates with a socket having a corresponding arrangement of female terminals. When the plug terminals are inserted into the socket holes, the plug terminals are placed in electrical contact with electrical "socket terminals" within the electrical socket. The socket terminals on a female socket may be referred to herein as female terminals, because these terminals are associated with the holes of the socket, even though the terminals may not themselves form a female socket. Though the male plug is generally fixed to an electrical device or appliance and the female socket is typically fixed, such as being secured to a wall, the reverse configuration is also possible.

An electrical socket is energized with electricity, such as from a commercial power supply or electrical generator, so that electric power can flow from the socket to an electronic device plugged into the socket. The electrical socket may be a "wall socket" included within a wall outlet of a building, for example. Other devices, such as PC battery-backup devices and power strips, plug into an electrical socket such as a wall socket, and include multiple on-board electrical sockets that receive electrical power from the wall socket. Yet another type of electrical socket may be included directly on an electronic device for daisy-chaining with additional electronic devices. For example, in a component stereo system, a primary audio component such as an audio receiver may include both a plug for plugging-into and receiving power from a wall socket or power strip, and one or more on-board electrical sockets that are wired to transfer some of the current from the wall socket or power strip to additional audio components plugged directly into the on-board electrical sockets. Other configurations of electrical sockets and mating electrical plugs are also known in the art.

One drawback of conventional plugs and sockets is the risk of exposure of the user to electrical shock, especially while the user plugs-in (connects) or un-plugs (disconnects) an electronic device. In particular, the plug terminals on a male plug typically extend directly from a plug body that the user grasps when plugging-in the device. Thus, the male plug terminals are typically exposed, and the user's fingers can be dangerously close to the male plug terminals when holding the plug body. When the electronic device is plugged in, the plug terminals contact the socket terminals prior to full insertion of the plug terminals into the socket holes. Likewise, when the electronic device is unplugged, the plug terminals may remain in electrical contact with the socket terminals until the plug terminals have been nearly fully removed from the socket holes. Thus, the plug terminals are energized for at least a portion of the movement of the plug with respect to the socket when either plugging-in or un-plugging an electronic device. The user risks electrical shock by inadvertently contacting the plug terminals with the user's fingers while the user is plugging-in or unplugging the electronic device.

The complications of conventional plugs and sockets are compounded in the case of power strips, which are usually loose rather than being fixed to any particular surface. Thus, to unplug an electronic device from a power strip, the user must usually hold the power strip while removing the plug. The tendency is for the user to hold the power strip with one hand while pulling on the plug with the other hand. This maneuver places both hands in potentially-dangerous proximity to electrically energized plug terminals of the device being unplugged, to electrically energized plug terminals of another device, or to open female socket terminals. Aside from the risk of shock, the process of removing a plug from a power strip may be cumbersome, as well. If the power strip is placed under a desk or other location with limited access and/or limited lighting, it can be difficult for the user to access the power strip with both hands. Some users might even be tempted to step on an edge of the power strip to hold it while pulling out the plug, which is also not ideal.

A solution is desired for improved connection of an electronic device to an electrical socket, particularly in view of the above limitations in the prior art plugs and sockets. For example, an apparatus that makes plugging-in and un-plugging a device easier and/or safer is desired. It would be advantageous if such a solution did not require any direct redesign of the electronic device, so that, for example, an electronic device having a conventional plug could still be coupled to and powered by an electrical socket using the proposed solution.

SUMMARY OF THE INVENTION

One embodiment provides a coupling for connecting and disconnecting an electrical plug and an electrical socket. A sleeve is slidably disposed on a first end of a coupling body. One or more male terminals on the first end of the coupling body are disposed within the sleeve and are configured for insertion into the electrical socket. A plug cavity at a second end of the coupling body is configured for receiving an electronic device plug. One or more interior electrical contacts are disposed within the coupling body in electrical communication with the one or more male terminals, and are configured for electrically contacting one or more plug terminals of the electronic device plug. The sleeve and coupling body are movable axially with respect to each other between a prong-extended position having the one or more male terminals on the coupling body extending out of the sleeve, and a prong-retracted position having the one or more male terminals substantially received within the sleeve. At least one release member is secured to the sleeve and to the coupling body. The at least one release member is movable to cause the sleeve and the coupling body to move with respect to each other from the prong-extended position to the prong-retracted position.

Other embodiments, aspects, and advantages of the invention will be apparent from the following description and the appended claims.

BRIEF DESCRIPTION OF THE DRAWINGS

FIG. 9 is a top view of the power strip with two alternately-configured couplings plugged in.

DETAILED DESCRIPTION OF PREFERRED EMBODIMENTS

Figure 1:
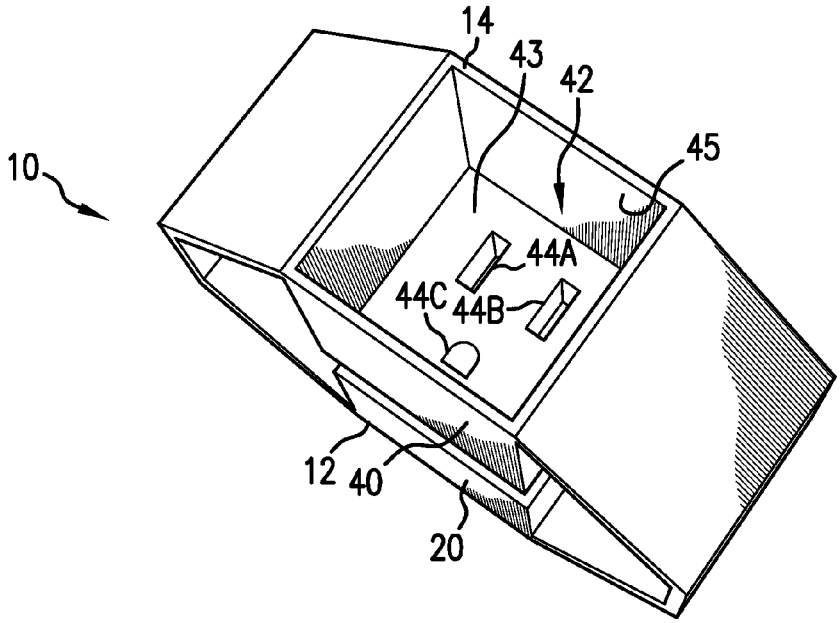
FIG. 1 is a perspective view of one end of a coupling used for connecting an electronic device to an electrical socket.

The present invention includes an apparatus that allows an electronic device to be safely and easily connected to and disconnected from an electrical power outlet. An apparatus according to the invention may be used to safely and easily connect an electronic device having a conventional plug to an electrical socket. The apparatus also allows the electronic device to be safely and easily unplugged from the electrical socket using only one hand. One-handed operation is possible even in the case of a power strip that is not secured in place. The risk of electrical shock is minimized because the terminals on the plug of the electronic device are shielded from the user's fingers as the device is plugged-in or unplugged, making it difficult or impossible for a user to contact live electrical terminals by hand.

One embodiment of the invention provides a coupling for connecting the electronic device to the electrical socket. The coupling includes a coupling body and a sleeve slidably disposed on a distal end of the coupling body. An arrangement of male terminals disposed on the distal end of the coupling body are configured for insertion into a corresponding arrangement of female terminals on the electrical socket. The plug of the electronic device is inserted into a proximal end of the coupling body, placing the plug terminals in communication with a plurality of interior electrical contacts disposed within the coupling body. The interior electrical contacts are internally connected to the male terminals at the distal end of the coupling body via electrical conductors disposed in the coupling body. Thus, the coupling mechanically and electronically connects the electronic device to the electrical socket. The proximal end of the coupling optionally includes a plug cavity having cavity walls that encircle the plug of the electronic device, particularly for preventing the user from contacting the prongs of the plug with the user's fingers once the prongs are in contact with the interior electrical contacts disposed within the coupling body. This is one of several aspects that enhance the safety of plugging-in and unplugging the electronic device by minimizing the likelihood of electrical shock.

The sleeve and coupling body are axially movable with respect to each other from a prong-extended position, wherein the male terminals on the coupling body extend out of the sleeve (where they can be plugged into the electrical socket), to a prong-retracted position, wherein the male terminals are substantially fully received within the sleeve. A release mechanism comprising at least one release member is secured to the sleeve and to the coupling body. The at least one release member is movable to cause the sleeve and coupling body to move with respect to each other from the prong-extended position to the prong-retracted position. This movement causes the male prongs to retract from the electrical socket, and can easily be performed with one hand, even when the coupling is plugged into an unsecured power strip or other power outlet.

FIG. 1 is a perspective view of a "coupling" 10, used for connecting an electronic device to an electrical socket according to one embodiment of the invention. The apparatus may be alternatively referred to as an adapter because it may be used as an intermediary component between a conventional plug and socket to simplify and enhance the safety of connecting the conventional plug and socket. Following a discussion of various features of the coupling 10, the manner and details of connecting the electronic device to an electrical socket using the coupling 10 will be further described with reference to subsequent figures. The coupling 10 includes a coupling body 40 and a sleeve 20 slidably disposed about a distal end 12 of the coupling body 40. The coupling body 40 includes a cavity 42 at a proximate end 14 of the coupling body 40, opposite the distal end 12 of the coupling body 40. The cavity 42 is sized for receiving a plug of an electronic device, such as a computer or appliance. In this embodiment, the cavity 42 is intended to receive a plug having male plug terminals. (An alternative embodiment having a cavity intended to receive a plug having female plug terminals is discussed below in relation to FIG. 7). A cavity floor 43 includes a socket having a plurality of socket holes 44A-C, arranged to receive a "three prong" type plug familiar to one skilled in the art. The particular arrangement of holes 44A-C shown and the corresponding arrangement of prongs to be received by the holes 44A-C is merely one example of a multiplicity of different terminal arrangements known in the art. Most of these arrangements are set forth in standards promulgated by various standards agencies around the globe.

Figure 2:
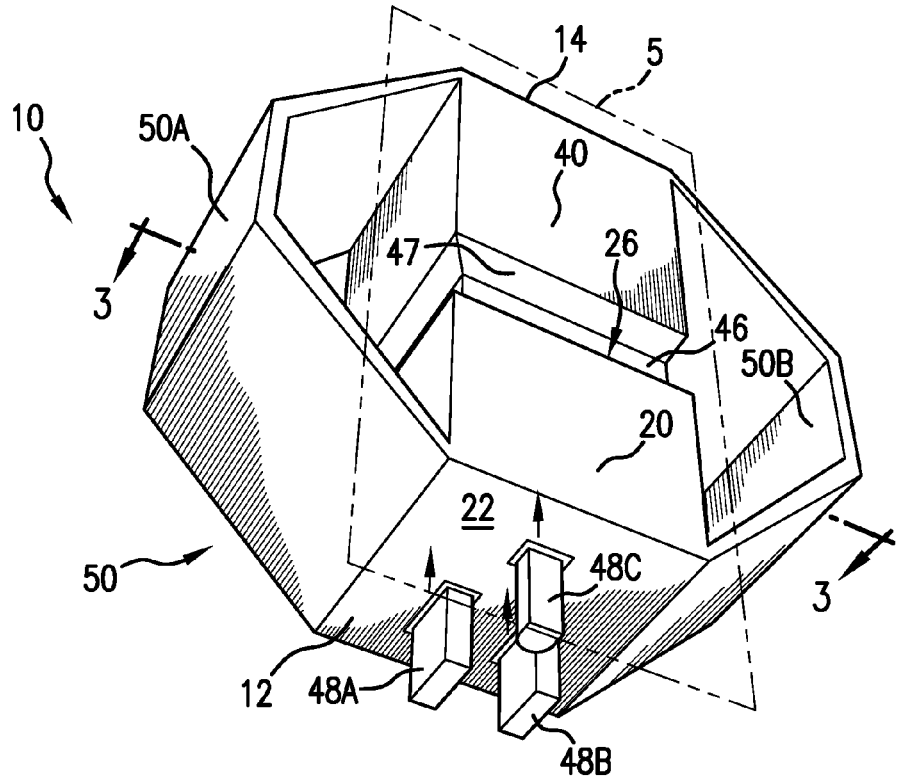
FIG. 2 is a perspective view of the coupling as viewed from the lower end.

FIG. 2 is a perspective view of the coupling 10 as viewed from the distal end 12 of the coupling body 40. The sleeve 20 includes a sleeve opening 26 that slidably receives a neck 46 of the coupling body 40. The generally rectangular cross-section of the neck 46 fits closely with the generally rectangular sleeve opening 26, to prevent any appreciable rotational movement of the sleeve 20 and coupling body 40 with respect to one another, and to constrain the sleeve 20 and coupling body 40 to linear movement with respect to one another. The close fit between the neck 46 and sleeve opening 26 provides alignment of the sleeve 20 and coupling body 40. A shoulder 47 on the coupling body 40 limits inward linear travel of the coupling body 40 with respect to the sleeve 20. An internal shoulder or lip (not shown) may also be included to provide a desired range of travel of the coupling body 40 with respect to the sleeve 20. An arrangement of three male terminals 48A-48C are secured to a lower end of the coupling body 40, and extend through apertures on an optional end wall 22 of the sleeve 20 opposite the coupling body 40.

A pair of opposing, outwardly-bowed release members 50A and 50B are coupled at one end to the sleeve 20 and at the other end to the coupling body 40. The release members 50A, 50B collectively constitute one exemplary embodiment of a "release mechanism," generally indicated at 50. The release members 50A, 50B are, in this embodiment, flexible plastic that, when in a relaxed state, bias the coupling 10 to the relative position of the sleeve 20 and coupling body 40 shown in FIGS. 1 and 2. In this aspect, the flexible release members 50A, 50B may also serve as biasing members to this "prong-extended" of "plug-extended" position. In the prong-extended position, the one or more male terminals 48A-48C of a plug extend outwardly of the coupling 10 past the end wall 22, so that they may be plugged into an electrical socket. However, when the release members 50A, 50B are moved inwardly, such as by squeezing them with the fingers of one hand, the coupling body 40 travels linearly outward with respect to the sleeve 20, which causes the male terminals 48A-48C to retract within the sleeve 20 to a "prong-retracted" or "plug-retracted" position. When fully received in the sleeve 20, the user cannot touch the male terminals 48A-48C. This relative movement of the sleeve 20 and coupling body 40 when the release member 50 is squeezed also causes the coupling 10 to be unplugged from an electrical socket, as will be further described below.

Figure 3:
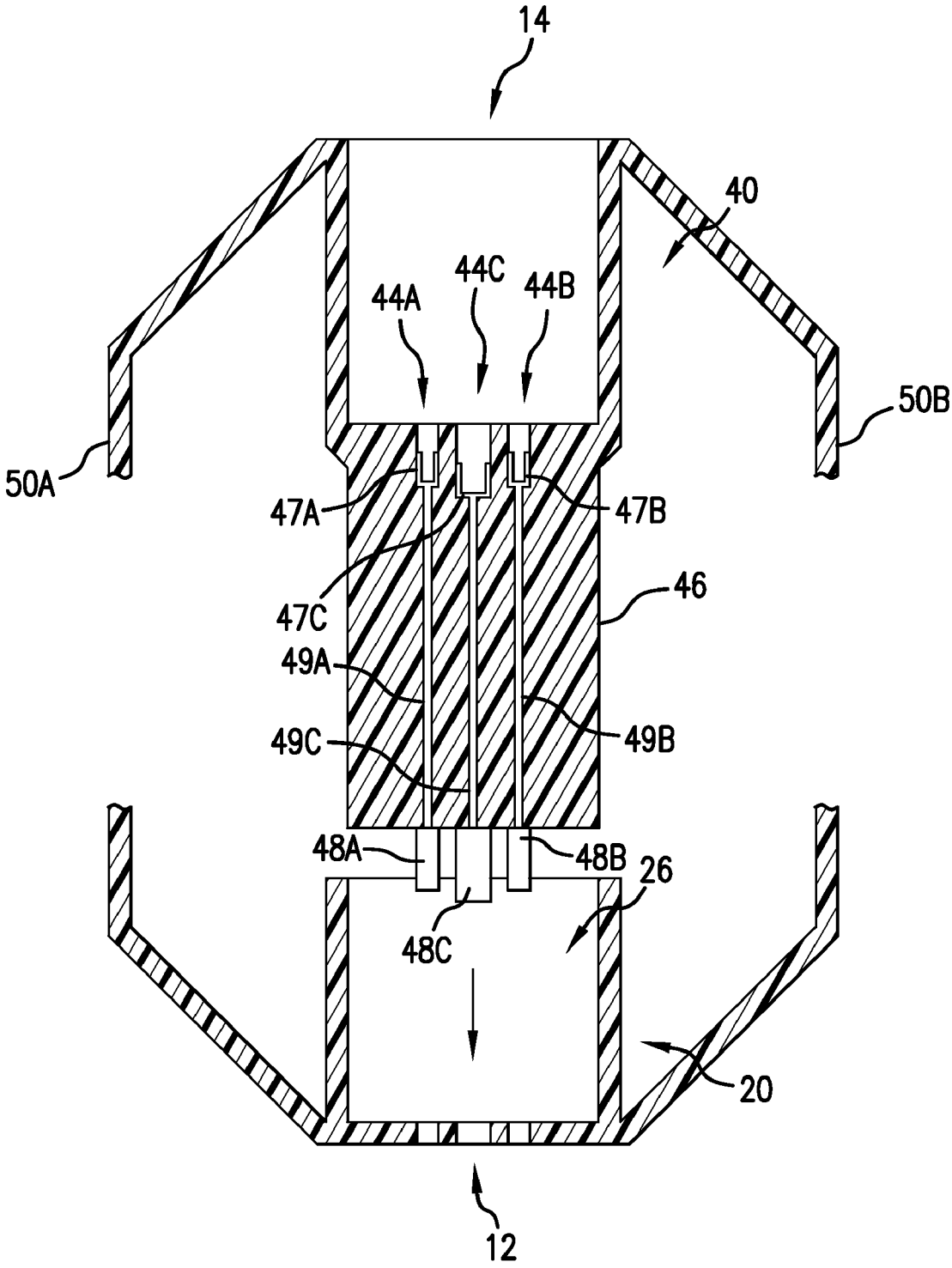
FIG. 3 is a partially-sectioned and exploded view of the coupling of FIG. 2.

FIG. 3 is a partially-sectioned and exploded view of the coupling 10, as taken through the reference plane 5 of FIG. 2. This view shows the sleeve 20 separated from the coupling body 40, so that these components may be seen without hidden lines, and with the release members 50A, 50B separated from the rest of the coupling 10. In a practical embodiment, however, the sleeve 20 and coupling body 40 and release members 50A, 50B may not be separable as shown. A female terminal 47A disposed in the hole 44A is in electrical communication with the male terminal 48A via an electrical conductor 49A, a female terminal 47B disposed in the hole 44B is in electrical communication with the male terminal 48B via an electrical conductor 49B, and a female terminal 47C disposed in the hole 44C is in electrical communication with the male terminal 48C via an electrical conductor 49C. Thus, when the male terminals 48A-44C are plugged into an electrical socket (not shown) at the distal end 12 of the coupling body 40, and a three-prong plug of an electronic device (not shown) is plugged into the proximate end 14 of the coupling body 40, the electronic device may receive electrical power from the electrical socket, as is further detailed with reference to subsequent figures.

The female terminals 47A-C are shown as having a generally female, U-shaped cross-section as shown, so that when male plug terminals are inserted into the socket holes 44A-C, those plug terminals will be in electrical contact with the female terminals 47A-C throughout a range of movement of insertion. Alternatively, however, the female terminals 47A-C could be given a flat, or otherwise substantially non-female cross-sectional shape, so that male plug terminals only make contact with the female terminals 47A-C when partially or fully inserted into the socket holes 44A-C. However, such an alternative, flat configuration of the terminals 47A-C would still be considered "female" in the context of this disclosure, due to the socket holes 44A-C that are predisposed to guiding male plug terminals into engagement with the terminals 47A-C. Cavity walls 45 partially surround the plug, providing a physical barrier between the plug and a user's fingers, to protect the user from potential shock.

Figure 4:
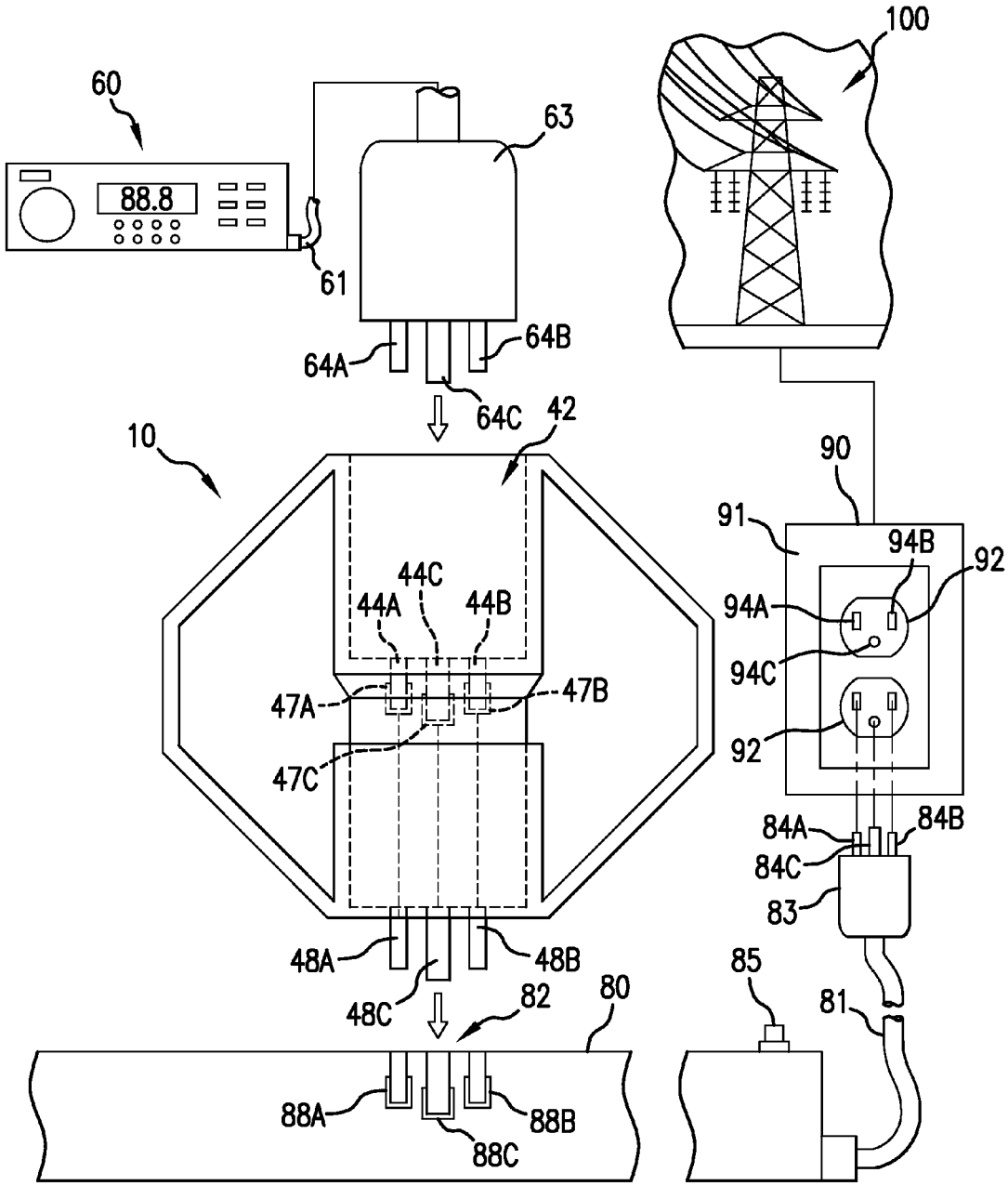
FIG. 4 is a schematic assembly diagram of an electronic device to be powered by being connected to a live power strip using the coupling.

FIG. 4 is a schematic assembly diagram of an electronic device 60 to be powered by being connected to a live power strip 80 using the coupling 10. The exemplary power strip 80 has a plug 83 at the end of a power cord 81. The plug 83 is configured for connection to an electrical outlet, such as a wall outlet 90 mounted on a wall 91. The exemplary wall outlet 90 includes two electrical sockets, which in this example are AC wall sockets 92. Each AC wall socket 92 on the wall outlet 90 includes a standardized arrangement of three socket holes, and the plug 83 has a like arrangement of three male terminals corresponding in one-to-one relationship with the three socket holes, so that the plug 83 may be plugged into one of the AC sockets 92. Electrical power is supplied to the wall outlet 90 by electricity transmitted from a power plant and distributed by transmission lines 100 to the building at which the wall 91 is located. The power strip 80 includes a plurality of on-board AC sockets 82 that are wired to the power cord 81 for receiving AC from the AC wall socket 92. A master power switch 85 is included for selectively supplying AC from the power cord 81 to the AC sockets 82 on the power strip 80. In this example, the master power switch 85 is switched to "ON," so that each socket 82 receives AC from the wall outlet 90. Another common power strip design includes a subset of AC sockets that are powered ON or OFF by a master power switch and another subset of AC sockets that are always ON, regardless of the position of the master power switch. The AC sockets 82 on the power strip may be wired in parallel with one another so that each AC socket 82 receives AC of like electrical parameters, e.g. each socket 82 receiving 120 Hz AC at a particular voltage and amperage from the AC socket 92. The electronic device 60, illustrated here by way of example as an audio receiver 60, includes a power cord 61 terminating in a three-prong plug 63. The plug 63 is inserted into the cavity 42 of the coupling 10, with the three prongs (male plug terminals) 64A-C inserted into the corresponding three socket holes 44A-44C in the coupling 10. The distal end 12 of the coupling 10 is plugged into the AC socket 82 on the power strip 80 by inserting the three male terminals 48A-C of the coupling 10 into the corresponding arrangement of three socket terminals 88A-88C included with one of the on-board AC sockets 82. Thus, the audio receiver 60 receives electrical power supplied from the transmission lines 100 to the wall outlet 90, which is carried from the wall outlet 90 to the receiver 10 through the power strip 80 by way of the coupling 10.

In the exemplary embodiment illustrated, the same three-terminal arrangement (e.g. three male plug terminals and three female socket terminals) is consistently used throughout to carry electrical power from the wall outlet 90 to the power strip 80, from the power strip 80 to the coupling 10, and from the coupling 10 to the receiver 60. This three-terminal arrangement is just one of many different configurations that may be selected. In this example, one of the three terminals in each three-terminal arrangement may be the "live contact," e.g. male terminals 64A, 48A, 84A and female terminals 47A, 88A, and 94A. Another of the three male terminals in each three-terminal arrangement may be the "neutral contact," e.g. male terminals 64B, 48B, 84B and female terminals 47B, 88B, and 94B. The third of the three terminals in each three-terminal arrangement may be an optional "ground contact," e.g. male terminals 64C, 48C, 84C and female terminals 47C, 88C, and 94C. The live contact (alternatively referred to as phase, hot, or active), along with the neutral contact, carries power from the power source (e.g. from the wall outlet 90) to the downstream component, e.g. to the power strip 80, coupling 10, and ultimately, to the device 60. The voltage between the live and neutral contacts typically varies by country, as set by national standards.

In some installations, there may be two live conductors, either being two phases from a three-phase system or being both phases from a split-phase system. As in the example of FIG. 4, some plug/socket combinations are designed in a way that a plug can be inserted only one possible way. This is referred to as a polarized plug (which is not to be confused with a designation of positive or negative polarity). Other plug/socket configurations, e.g. a symmetrical two-terminal arrangement, allow the plug to be inserted with live and neutral either way around. This is sometimes referred to as an unpolarized arrangement. Moreover, even if live and neutral can only connect in one orientation, in some countries it is common to wire them together without regard for which is which.

The neutral contact, along with a live contact, completes the circuit between the power source and equipment. The neutral contact may be chosen as the zero voltage reference point, with the live contact's voltage measured with respect to it. In many cases, local electrical regulations require the neutral contact to be connected to earth/ground. In such systems, even though the neutral conductor is at a very low voltage with respect to the ground, it is insulated for the full supply voltage in case of a fault, such as a break in the wiring between neutral and source.

The ground contact (sometimes referred to as the "earth" contact) is generally intended to carry electric current when connected to equipment that has developed an insulation fault. The ground connection was added to modern plugs because, if a live wire or other component in a device touches the metal casing, anybody touching the device may receive a dangerous electric shock. In many countries devices with metal cases must have the case connected to the ground contact. This reduces but does not eliminate the possibility of the case developing a high voltage relative to the ground and grounded metalwork.

Figure 5:
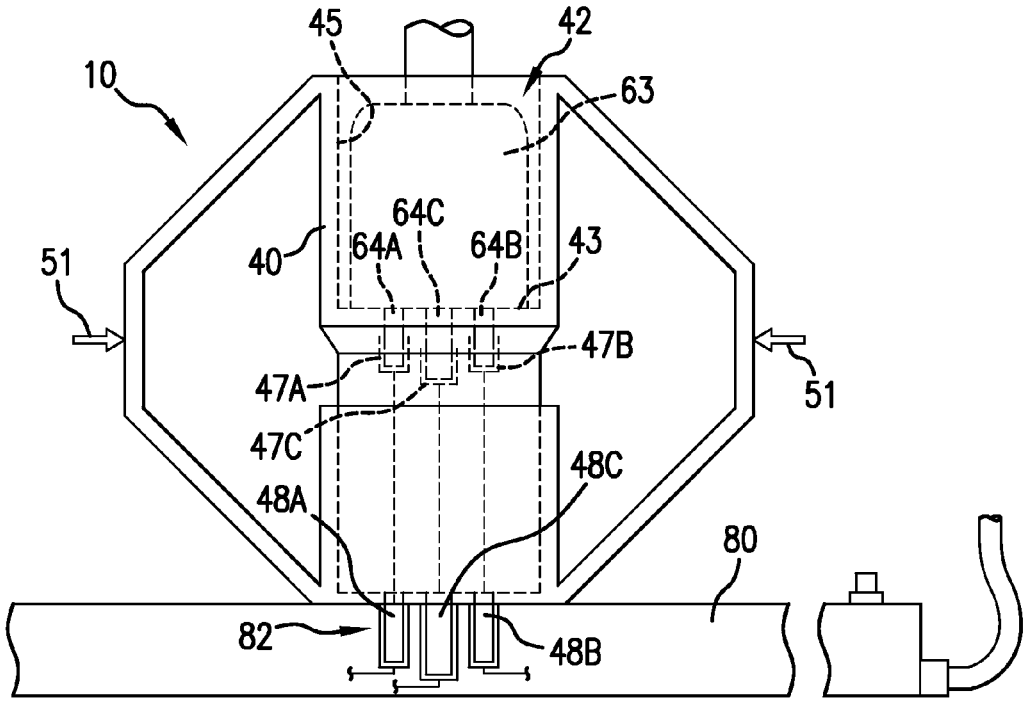
FIG. 5 is a side view of the coupling illustrating a manner of using the coupling to connect the electronic device of FIG. 4 to the power strip.

FIG. 5 is a side view of the coupling 10 illustrating a manner of using the coupling 10 to connect the electronic device 60 of FIG. 4 to the power strip 80. The electronic device plug 63 is fully inserted into the cavity 42, such that the electronic device plug 63 engages and is stopped against the cavity floor 43. The cavity walls 45 have a height relative to the cavity floor 43 such that the cavity walls 45 enclose the electronic device plug 63 when so inserted. It is possible to first plug the coupling 10 into the power strip 80, and then plug-in the plug 63 into the cavity 42. Alternatively, the plug 63 may first be plugged into the cavity 42 of the coupling 10, and the coupling 10 may then be plugged into the power strip 80. Regardless of the order, the user's fingers will be protected. If the plug 63 is first inserted into the cavity 42, the prongs 64A-C will be surrounded by the cavity walls 45 prior to plugging the coupling 10 into the power strip 80. Alternatively, if the coupling 10 is first plugged in to the power strip, the prongs 64A-C of the plug 63 will be protected by the cavity walls 45 by the time the prongs 64A-C make contact with the then-live socket terminals 47A-C.

To plug in the coupling 10 to the power strip 80, the user may grasp the coupling body 40, and then plug in the coupling 10 to the AC socket 82 in the power strip 80. Grasping the coupling body 40 near the proximate end 14 is convenient for the user, because the proximate end 14 is generally closer to the user's hand as the user is plugging the coupling 10 into the power strip 80. Grasping the coupling 10 by the coupling body 40 will help ensure that the male terminals 48A-C are fully inserted into the AC socket 82, because the male terminals 48A-C are rigidly secured to the coupling body 40 in this embodiment. It may also be possible to plug the coupling 10 into the on-board AC socket 82 while grasping the sleeve 20, depending on the rigidity of the release members 50A, 50B and the tightness of the fit of the male terminals 48A-C with the socket holes of the on-board AC socket 82. However, if the fit between the male terminals 48A-C and the AC socket 82 is sufficiently snug, and/or if the release members 50A, 50B are sufficiently flexible, then grasping the coupling 10 by the sleeve 20 when plugging-in the coupling 10 may instead cause the release members 50A, 50B to simply flex inwardly and the male terminals 48-C to retract at least partially into the sleeve 20, rather than being fully inserted into the AC socket 82. Some manufacturers may even prefer this aspect for safety, to discourage plugging-in the coupling 10 while holding the sleeve 20 that will be nearer to the live on-board AC socket 82.

With the plug 63 fully inserted into the cavity 42 and the coupling 10 fully inserted into the AC socket 82, electric power may be transferred from the power strip to the electronic device 60 (FIG. 4), as reliably as if the plug 63 were instead plugged directly into the AC socket 82. Using the release mechanism 50, the electronic device 60 (FIG. 4) may be subsequently disconnected from the power strip 80 by squeezing the release members 50A, 50B inward, in the direction indicated by arrows 51.

Figure 6:
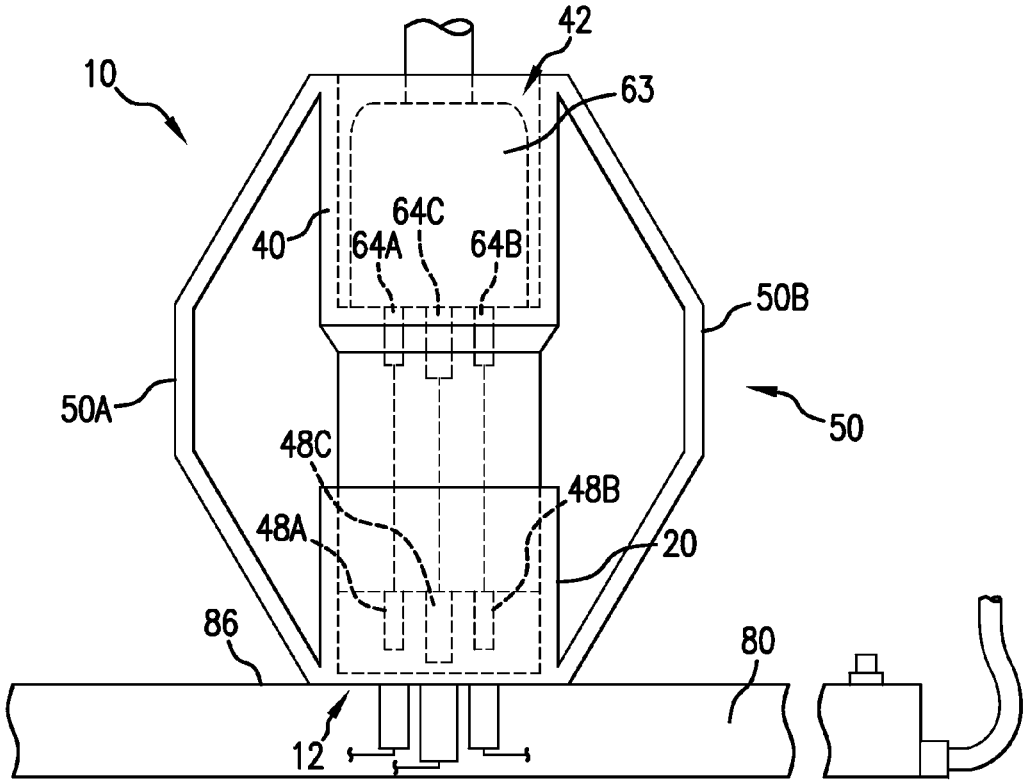
FIG. 6 is a side view of the coupling illustrating a manner of using the coupling to disconnect the coupling from the power strip.

FIG. 6 is a side view of the coupling 10 illustrating a manner of using the coupling 10 to disconnect the coupling 10 (and the electronic device 60 connected thereto) from the power strip 80. In particular, the opposing release members 50A and 50B are squeezed to move them inwardly toward one another, causing the coupling body 40 to move upward relative to the sleeve 20, which is disposed against an upper surface 86 of the power strip 80. The sleeve 20 is leveraged against the upper surface 86 of the power strip 80, so that this movement of the coupling body 40 relative to the sleeve 20 will urge the coupling body 40 up, away from the power strip 80, thereby causing the prongs 48A-C to retract into the sleeve 20. Advantageously, this movement may be performed with a single hand. It is not necessary to hold the power strip 80 when doing so, because of the leverage of the sleeve 20 against the rigid upper surface 86 of the power strip 80. Furthermore, the coupling 10 makes disconnecting the electronic device 60 from the power strip 80 safer, in that the prongs 64A-C of the plug 63 are protected inside the cavity 42, and the prongs 48A-C are disposed within the sleeve 20 throughout the entire process of disconnecting the coupling 10 from the power strip 80. Once the coupling 10 is disconnected and removed from the power strip 80, the flexible release members 50A-C will return to their relaxed position, thus "springing" back to more or less the original, relaxed coupling position shown in FIG. 2.

Figure 7:
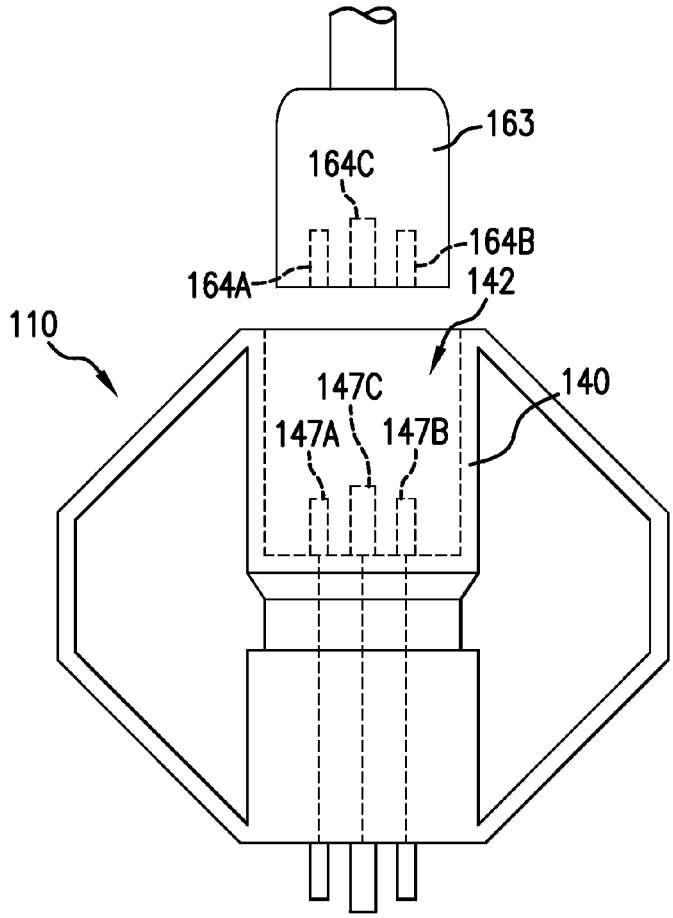
FIG. 7 is a side view of an alternative embodiment of the coupling for use with a device plug having female plug terminals.

As previously indicated, many different plug/socket arrangements may be used with the invention. FIG. 7 is a side view of an alternative embodiment of the coupling 110 for use with a device plug 163 having female plug terminals 164A-C, instead of the male terminals 64A-C of FIGS. 1-6. Likewise, the cavity 142 of the coupling body 140 includes three male socket terminals 147A-C configured for insertion into the female terminals 164A-C when the plug 163 is inserted into the cavity 142. This is yet another example of how the invention may be applied to alternative arrangements and configurations of plug terminals and socket terminals. Furthermore, although the embodiment of FIG. 4 conveniently uses the same three-prong configuration throughout, alternative embodiments may be constructed according to the invention wherein more than one plug/socket configuration is used in connecting an electronic device to an electrical outlet. For example, a wall outlet may include a three-prong socket configuration, while the coupling 10 may be wired to allow a device to be plugged in having only a 2-prong configuration. One skilled in the art may use any of a variety of wiring techniques known in the art to adapt the invention to particular preferences regarding wiring, plug/socket configurations, and other electrical parameters. It is also possible to construct an embodiment of a coupling to convey direct current (DC) from a DC socket, through a coupling, to an electronic device. It is further possible to construct an embodiment wherein the coupling plugs at one end into an AC socket and, using electrical engineering techniques known in the art, to convert the AC current to DC internally within the coupling 10 to ultimately supply DC to the electronic device plugged into the coupling. Still further, it should be recognized that the orientation of the three socket holes 44A-44C may differ from the orientation of the prongs 48A-C. Similarly, the orientation of the release members 50A, 50B relative to the orientation of the three socket holes 44A-44C or the prongs 48A-C may be different. For example, typical residential wall sockets are spaced vertically such that the orientation of the release members in FIGS. 1-8 will not interfere with a vertically adjacent plug or socket. Furthermore, positioning the release members at 90 degrees from that of FIGS. 1-8 may avoid adjacent sockets in an outlet strip, depending upon the orientation of the sockets.

Figure 8:
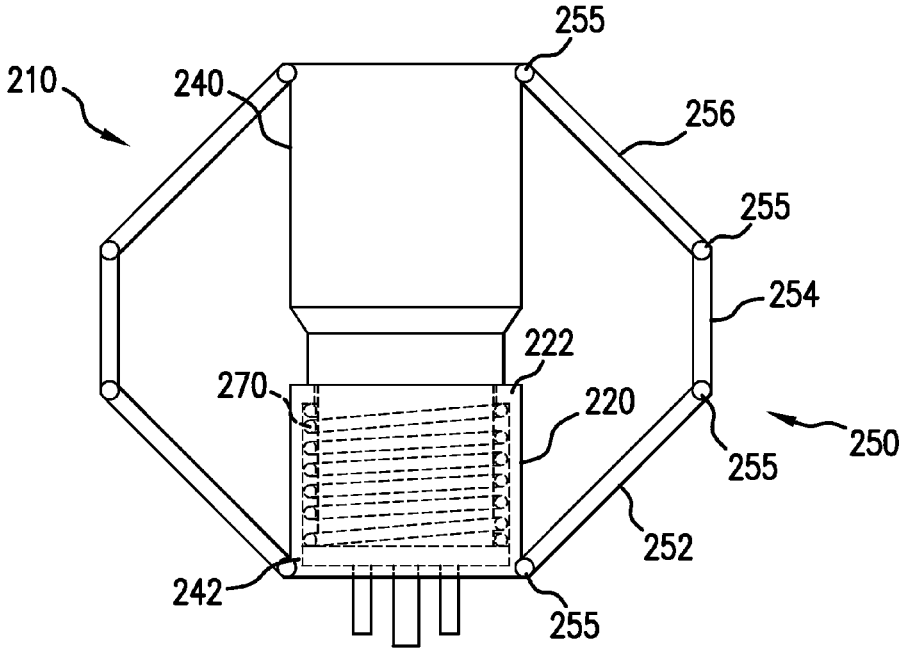
FIG. 8 is a side view of another embodiment of a coupling having an alternative release mechanism.

FIG. 8 is a side view of another embodiment of a coupling 210 having an alternative, schematically-illustrated release mechanism generally indicated at 250. Here, a coupling body 240 is slidably disposed within a sleeve 220, similar to the sliding configuration of sleeve 20 and coupling body 40 in FIGS. 1-6. However, rather than having flexible release members, the release mechanism 250 instead includes substantially non-flexible release members 250A, 250B. The release members 250A, 250B each include segments held together by pivot members schematically shown as pins 255. Constructed in this manner, the release members 250A, 250B still provide the ability to move the sleeve 220 with respect to the coupling body 240 when squeezing the release members 250A, 250B toward one another. However, this construction of the release members 250A, 250B, alone, does not provide any appreciable biasing to bias the sleeve 220 and coupling body 240 to a particular position. Rather, an eccentrically-mounted spring 270 is disposed in an annulus between the sleeve 220 and the coupling body 240. The coupling body 240 includes a spring stop 242 at one end of the spring 270 and the sleeve 220 includes a spring stop 222 at an opposing end of the spring 270. Thus, the sleeve 220 and the coupling body 240 are biased to the position shown by virtue of the spring 270. While this embodiment gives another example of a biasing mechanism for biasing the sleeve 220 with respect to coupling body 240, still other biasing mechanism and release mechanisms may be devised that remain within the scope of the invention, as claimed.

Figure 9:
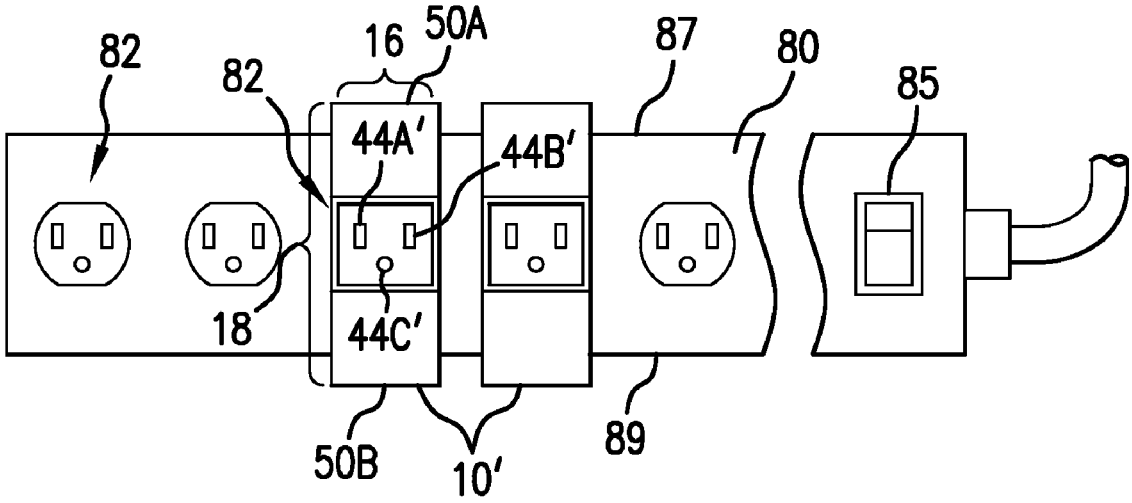

FIG. 9 is a top view of the power strip 80 with two couplings 10' plugged in. The couplings 10' have an alternate configuration that includes substantially all of the elements discussed with reference to the coupling 10, except that the arrangement of socket holes 44A'-44C' is rotated ninety degrees with respect to the arrangement of socket holes 44A-44C shown in FIG. 1. When plugged into an electrical socket 82 on the power strip 80, this configuration of the coupling 10' conveniently places the release members 50A and 50B parallel to opposing edges 87, 89 of the power strip 80, making it easier to grasp the release members 50A and 50B. Because the edge 16 is shorter than the edge 18 of each coupling 10', this orientation of the socket holes 44A'-44C' also allows more clearance and/or a closer spacing between adjacent couplings 10'.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A coupling for connecting and disconnecting an electrical plug with an electrical socket, comprising:

a coupling body and a sleeve slidably disposed on a first end of the coupling body, one or more male terminals on the coupling body at the first end disposed within the sleeve and configured for insertion into the electrical socket, a plug cavity at a second end of the coupling body for receiving an electronic device plug, one or more interior electrical contacts disposed within the coupling body in electrical communication with the one or more male terminals and configured for electrically contacting one or more plug terminals of the electronic device plug, wherein the sleeve and coupling body are movable axially with respect to each other between a prong-extended position having the one or more male terminals on the coupling body extending out of the sleeve, and a prong-retracted position having the one or more male terminals substantially received within the sleeve; and at least one release member secured at one end to the sleeve and at the other end to the coupling body, wherein the at least one release member is operable to cause the sleeve and the coupling body to move with respect to each other from the prong-extended position to the prong-retracted position.

2. The coupling of claim 1, wherein the at least one release member is operable using a single hand.

3. The coupling of claim 1, wherein the at least one release member is operable by squeezing the at least one release member.

4. The coupling of claim 1, wherein the at least one release member is flexible, such that flexing the at least one release member inward moves the sleeve and the coupling body with respect to each other from the prong-extended position to the prong-retracted position.

5. The coupling of claim 4, wherein the one or more flexible release members are each flexible inward from a relaxed state, wherein the sleeve and coupling body are in the prong-extended position, to an inwardly-flexed state, wherein the sleeve and coupling body are moved to the prong-retracted position and biased by the flexible release members toward the prong-extended position.

6. The coupling of claim 4, wherein the one or more flexible release members comprises two opposing, outwardly-bowed release members.

7. The coupling of claim 1, further comprising a biasing member for biasing the sleeve and coupling body to the prong-extended position.

8. The coupling of claim 7, wherein the biasing member comprises a spring disposed between the sleeve and coupling body, wherein moving the sleeve and coupling body from the prong-extended position to the prong-retracted position causes the spring to bias the sleeve and coupling body back toward the prong-extended position.

9. The coupling of claim 1, wherein the cavity defines a cavity floor for limiting axial insertion of the electronic device plug into the cavity.

10. The coupling of claim 9, wherein the interior electrical contacts are disposed beneath the cavity floor, and further comprising a plurality of socket holes extending through the cavity floor to the interior electrical contacts, for receiving a plurality of male plug terminals of the electronic device plug.

11. The coupling of claim 9, wherein the interior electrical contacts extend beyond the cavity floor into the cavity for contact with female plug terminals of the electronic device plug.

12. The coupling of claim 1, wherein the one or more male terminals are selected from the group consisting of live terminals, neutral terminals, ground terminals, or combinations thereof.

13. A coupling for connecting and disconnecting an electrical plug with an electrical socket, comprising:

a coupling body including a first end having an electrical plug configured for insertion into an electrical source socket, a second end having an electrical socket configured for receiving an electronic device plug, wherein the electrical plug and electrical socket are in electronic communication through the coupling body;

a sleeve disposed about the first end of the coupling body; and at least one release member secured at one end to the sleeve and at the other end to the coupling body and movable to cause the sleeve to extend axially with respect to the coupling body from a plug-extended position wherein the electrical plug extends beyond the sleeve to a plug-retracted position wherein the electrical plug is substantially received within the sleeve.

14. The coupling of claim 13, wherein the coupling body includes one or more interior electrical contacts disposed within the electrical socket and providing electrical communication between the electrical plug and the electrical socket.

15. The coupling of claim 13, wherein the at least one release member is operable using a single hand.

16. The coupling of claim 13, wherein the at least one release member is operable by squeezing the at least one release member.

17. The coupling of claim 13, wherein the at least one release member is flexible, such that flexing the at least one release member inward moves the sleeve and the coupling body with respect to each other from the prong-extended position to the prong-retracted position.

18. The coupling of claim 17, wherein each flexible release member extends outward from the coupling body and sleeve and is flexible inward.

19. The coupling of claim 17, wherein the at least one flexible release member comprises two opposing, outwardly-bowed flexible release members.

20. The coupling of claim 1, further comprising a biasing member for biasing the sleeve and coupling body toward the plug-extended position.

* * * * *